United States Patent [19]

Zucker

[11] 4,040,204

[45] Aug. 9, 1977

[54] VEHICLE BANK WITH CLOSURE RETAINED BY VEHICLE MECHANISM PORTION

[75] Inventor: Armand S. Zucker, Skokie, Ill.

[73] Assignee: Callen Manufacturing Corporation, Melrose Park, Ill.

[21] Appl. No.: 691,452

[22] Filed: June 1, 1976

[51] Int. Cl.[2] ..... A63H 33/30

[52] U.S. Cl. ..... 46/2; 46/222

[58] Field of Search ..... 46/2, 3, 4, 5, 222

[56] References Cited

U.S. PATENT DOCUMENTS

| | | | |
|---|---|---|---|
| 1,878,615 | 9/1932 | Wood | 46/2 |
| 2,078,767 | 4/1937 | Marx | 46/2 |

FOREIGN PATENT DOCUMENTS

| | | | |
|---|---|---|---|
| 614,195 | 2/1961 | Canada | 46/3 |

*Primary Examiner*—F. Barry Shay

[57] ABSTRACT

A miniature bank having the form of an armored safety-deposit truck whose coin-compartment is closed by a back gate. The latter extends forwardly under the compartment with a tongue which crosses over the rear axle of the truck. The axle therefore bars the tongue, and keeps the back gate from being opened. The wheels are made flexible, so that either can be pulled off the axle and permit it to be retracted to a point no longer blocking the tongue. The back gate may now be raised open. This procedure is kept secret from a juvenile owner of the bank; and the normal appearance of the wheel mechanism disguises its alternate manipulation.

7 Claims, 4 Drawing Figures

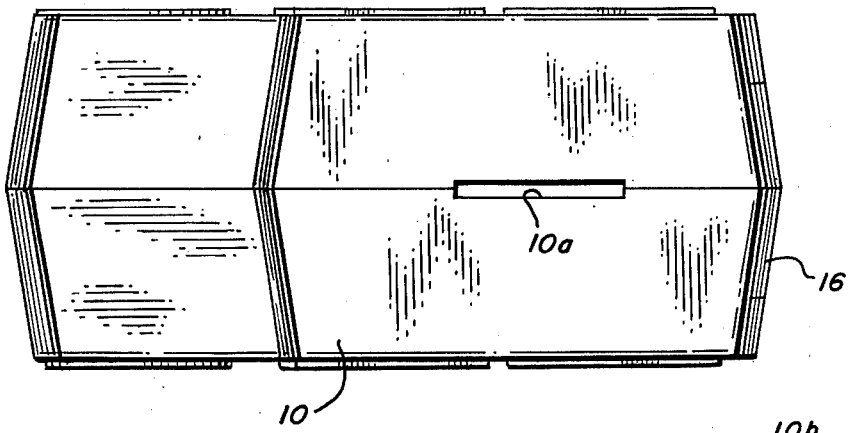
FIG. 1
FIG. 2
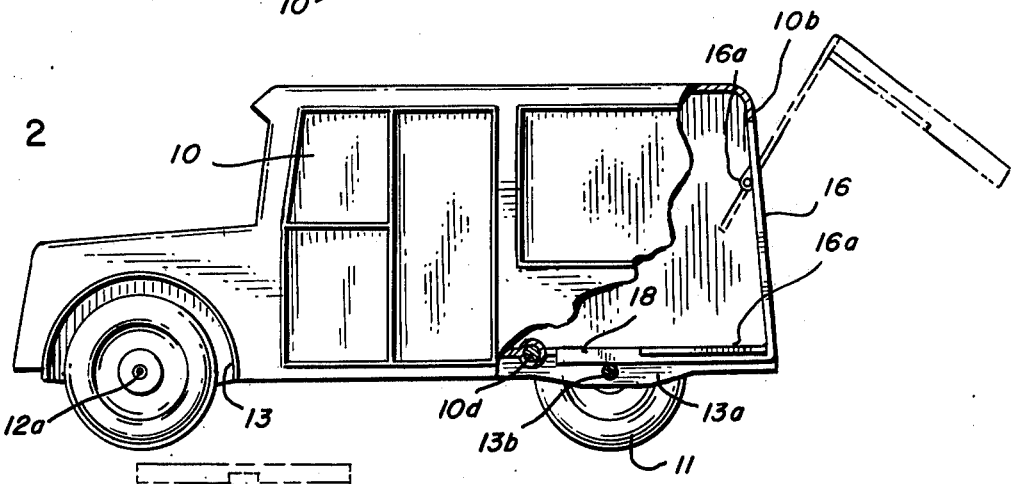
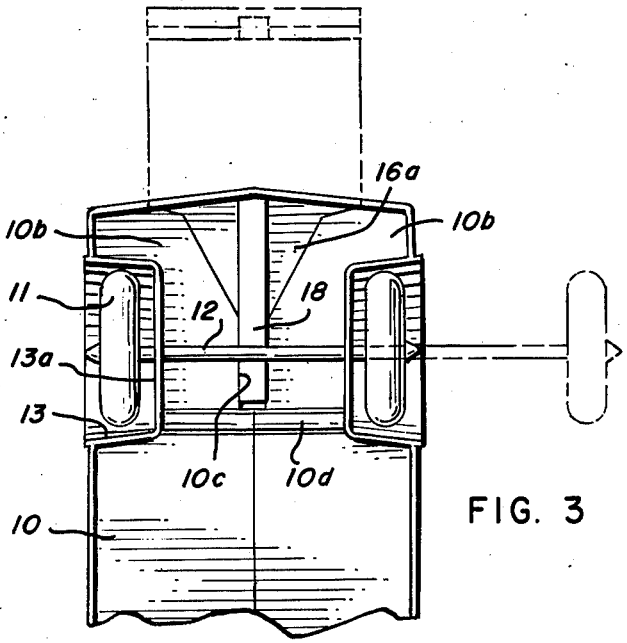
FIG. 3
FIG. 4
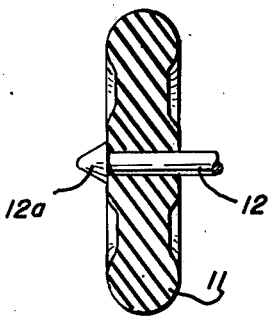

VEHICLE BANK WITH CLOSURE RETAINED BY VEHICLE MECHANISM PORTION

This invention relates to miniature banks in which coins are saved by children, and more particularly to banks which simulate some popular object, character or article of utility, and one object is to lend the bank a factor of novelty by shaping it as an armored safety-deposit truck.

A further object is to design a bank of the above character in which the slot for the deposit of coins is in direct view on top of the bank and therefore handy for the deposit of coins.

A still further object is to use the main body of the bank as a spacious coin compartment, and provide a lid simulating the back gate of a truck designed to be raised when the bank is held with the back end up for the removal of coins contained therein.

An additional object is to provide means usually keeping the back gate locked, not by means of a key, but by parts of the bank which appear like belonging to a truck.

Another object is to design the bank to all appearances as a miniature truck, with no parts suggesting how to open the back gate, in order that the way to open it may be kept secret from the child owning the bank, and the temptation to open it avoided.

A final object is to construct the novel bank mainly of die castings, and with companion sections assembled along the center, whereby to form a compact and rigid structure.

A better understanding of the invention may be gained by reference to the accompanying drawing, in which FIG. 1 is a plan view of the bank;

FIG. 2 is a side elevation, broken away at the rear;

FIG. 3 is a bottom view with the rear end of the bank up; and

FIG. 4 is an enlarged section of a wheel and its support.

Referring specifically to the drawing, 10 denotes the body of the bank, which is preferably made of companion sections assembled along a center line seen in FIG. 1. The body has a slot 10*a* in its top for the handy deposit of coins, and combines with the wheels 11 to give the bank the appearance of an armored safety-deposit truck. The body has arched side wells 13 in which the wheels are located; and the side wells have inner walls 13*a* through which the round wheel axles 12 pass, the circular openings in the walls 13*a* for this purpose being slightly larger, as seen at 13*b* in FIG. 2.

The wheels 11 are of flexible rubber, and bored centrally for slidable mounting on the axles to the position shown in FIG. 4; and the axles have terminal heads 12*a* of conical form which lock the wheels from sliding off the axles. The placement of the wheels is identical both in front and at the rear. Therefore, only the rear placement is shown in FIG. 3. The wheels and axles constitute functional mechanisms enabling the vehicle to function as a conventional toy truck.

The invention resides in the rear part of the bank, where a back gate 16 forms the closure indicated by full lines in FIG. 2. The back gate has side pins 16*a* near the top to pivot it in the sides of the rear body wall 10*b.* Also, the back gate has an inward bottom web 16*a* which is at the level of companion floor sections 10*b* of the bank body 10. The web is tapered forwardly from the sides to lie between the similarly formed floor sections; and these extend with a slot 10*c* to a circular cross-bar 10*d* reinforcing the floor. A medial tongue 18 makes the web 16*a* thicker along the center, and enters the slot 10*c* as shown in FIG. 3.

The tongue 18 lies slightly above the rear axle 14 when the back gate is closed, as indicated by full lines in FIG. 2. The axle therefore locks the back gate from being opened to a position indicated by finely-dotted lines in FIG. 2. However, when it is desired to empty the bank of coins accumulated therein, it is preferably done by an adult, and not in the presence of the juvenile owner of the bank. While the latter may be held in any position affording access to its back end, it is preferable to stand the bank with the back end up, as shown in FIG. 3. Now the first step toward opening the back gate is to flex the left-hand wheel 11 off the axle. This permits the latter to be drawn out to the right, such as to a position indicated by finely-dotted lines in the same figure. Now the axle no longer bars the tongue 18; and the back gate may be raised to the open position indicated by the finely-dotted lines in the same figure, which corresponds to that position in FIG. 2. This uncovers a large opening into the bank; and the latter may then be tilted to pour its coin contents into a handy receptacle.

It is now apparent that the flexibility of the wheels enables either one at the rear to be pulled off the axle; and the enlarged openings 13*b* provide clearance for the passage of the conical head 11*a* of the axle through the walls 13*a* as it is withdrawn in the manner described.

The invention may now be understood as a bank closure control which does not reveal its presence or the manner of its manipulation, except to one familiar with it. To all intents and purposes the bank has the appearance of a miniature armored safety-deposit truck with visible parts presenting a natural image; and the necessity of removing a wheel to open the back gate would not occur to the average observer because that is not done to open the back gate of a real truck.

The invention therefore provides a safeguard against the premature opening of the bank by its juvenile owner, at least until the secret of opening the back gate is revealed.

I claim:

1. A miniature bank comprising a functional toy vehicle having a functional toy vehicle mechanism enabling conventional use of said vehicle, said vehicle having also a coin compartment, a closure for the latter which opens to permit the removal of coins, and a unit of the vehicle mechanism serving as a bar to the opening of said closure, said unit being independent of said closure and shiftable to release the closure.

2. The structure of claim 1, the closure having an extension under the compartment, and the unit being an axle of the vehicle located under the extension.

3. The structure of claim 1, the closure having an extension under the compartment, and the unit being the rear axle of the vehicle located under the extension.

4. The structure of claim 1, the closure having an extension under the compartment, said unit being an axle of the vehicle journaled in body bearings, and a pair of wheels mounted on the axle outwardly of the bearings, the axle retractable through one of them to clear the extension when the related wheel is removed.

5. The structure of claim 4, the axle having terminal heads to retain the wheels, and the bearings having openings affording the passage of either axle head when the axle is retracted as stated.

6. The structure of claim 5, the wheels being flexible to surmount either axle head when a wheel removal takes place, and such head being tapered outwardly for easier re-mounting of the wheel.

7. The structure of claim 2, said closure being a back gate hinged near the top to the rear of said compartment, and the extension being a tongue directed forwardly from the bottom of the gate.

* * * * *